US009332595B2

(12) United States Patent
Caligiuri

(10) Patent No.: US 9,332,595 B2
(45) Date of Patent: May 3, 2016

(54) MICROWAVEABLE HEAT RETENTIVE CONTAINER

(71) Applicant: Jeanne M. Caligiuri, Las Vegas, NV (US)

(72) Inventor: Jeanne M. Caligiuri, Las Vegas, NV (US)

( * ) Notice: Subject to any disclaimer, the term of this patent is extended or adjusted under 35 U.S.C. 154(b) by 366 days.

(21) Appl. No.: 13/803,739

(22) Filed: Mar. 14, 2013

(65) Prior Publication Data

US 2013/0273218 A1 Oct. 17, 2013

Related U.S. Application Data

(60) Provisional application No. 61/622,735, filed on Apr. 11, 2012.

(51) Int. Cl.
*H05B 6/80* (2006.01)
*H05B 6/64* (2006.01)

(52) U.S. Cl.
CPC ..... *H05B 6/6408* (2013.01); *H05B 6/6494* (2013.01)

(58) Field of Classification Search
CPC ..... H05B 6/6494; H05B 6/6408
USPC ..... 219/725, 730–735, 762, 757, 759, 689; 426/234, 241, 243, 89, 93; 99/DIG. 14, 99/340, 483; 206/545, 546
See application file for complete search history.

(56) References Cited

U.S. PATENT DOCUMENTS

| | | | | |
|---|---|---|---|---|
| 2,781,960 | A | 11/1953 | Dick | |
| 4,743,726 | A * | 5/1988 | Hughes et al. | 219/759 |
| 5,144,106 | A * | 9/1992 | Kearns et al. | 219/731 |
| 5,317,128 | A | 5/1994 | Yao | |
| 5,916,470 | A | 6/1999 | Besser et al. | |
| 6,147,337 | A | 11/2000 | Besser | |
| 6,227,192 | B1 | 5/2001 | Schake | |
| 6,627,857 | B1 | 9/2003 | Tanner et al. | |
| 7,067,772 | B2 | 6/2006 | Tanner et al. | |
| 7,812,293 | B2 | 10/2010 | Su et al. | |
| 7,905,224 | B2 | 3/2011 | Flather | |
| 2004/0187859 | A1 | 9/2004 | Tseng | |
| 2006/0186297 | A1 | 8/2006 | Lore, Sr. | |
| 2010/0260900 | A1 * | 10/2010 | DeVerney et al. | 426/107 |
| 2010/0301061 | A1 | 12/2010 | Clark | |

FOREIGN PATENT DOCUMENTS

AU 2003203433 A1 * 10/2003

* cited by examiner

*Primary Examiner* — Quang Van
(74) *Attorney, Agent, or Firm* — JP Webb; Jason P. Webb; Danny Y. H. Cheng

(57) ABSTRACT

The present invention is directed to a portable and microwaveable container into which a vessel may be inserted, and which assists in preserving or prolonging elevated temperatures of the contents of the vessel for an extended period of time. The container includes a receptacle area, or opening, into which the vessel is inserted. The container of the present invention may be heated, such as in a microwave oven, and once heated, a vessel containing a warmed food product, typically an elevated temperature liquid, may be inserted. The container of the present invention internally contains a microwaveable absorbing material which retains thermal energy. Once heated, the container passively improves the heat retention of the contents of the inserted vessel.

12 Claims, 6 Drawing Sheets

MICROWAVEABLE HEAT RETENTIVE CONTAINER

This application claims priority to U.S. Provisional Patent Application No. 61/622,735 filed on Apr. 11, 2012 and incorporated herein by reference.

FIELD OF THE INVENTION

The present invention is directed to a container for improving heat retention of a food product in a vessel by providing a heatable insulating container for surrounding the vessel.

BRIEF DESCRIPTION OF THE INVENTION

The present invention is directed to a portable and microwaveable container into which a mug or bowl (a "vessel" or "mug") may be inserted, and which assists in preserving or prolonging elevated temperatures of the contents of the vessel for an extended period of time. The container includes a receptacle area, or opening, into which the vessel is inserted. The container of the present invention may be heated, such as in a microwave oven, and once heated, a vessel containing a warmed food product, typically an elevated temperature liquid, may be inserted. The container of the present invention internally contains a microwaveable absorbing material which retains thermal energy. Once heated, the container passively improves the heat retention of the contents of the inserted vessel.

BACKGROUND OF THE PRESENT INVENTION

Because people take their time sipping hot beverages, it is desirous to retain the temperature of the beverage and preserve the beverage's integrity for as long as possible. Maintaining the temperature, especially of a beverage such as coffee or tea, has been a challenge. Various attempts have been made to maintain the temperature of a desired beverage or food in a vessel. For example, electrically heated hot plates for individual mugs or candles require an electrical outlet to sustain the heat or a wick to produce a fire source of heat.

The devices in the prior art suffer from certain drawbacks. Hot plate style devices require a constant flow of electricity and an electrical outlet needs to be proximate which is not always the case. Even battery-powered hot plates have similar issues—to maintain the temperature of the contents of the vessel, the plate must be kept "on" and becomes hot to the touch, resulting in possible burns for the user. Additional issues include a scalded taste for the contents, and a paper item may be accidentally laid on top of the hot plate or be ignited by proximity to the heating element, which might even include an open flame. Some powerful warmers cause evaporation over time and thereby cause the remaining contents to result in a gummy residue and the scalded taste. Forgetting to turn the warmer off can be problematic, dangerous and an unnecessary use of electricity. Someone may burn themselves on the hot plate. Specialized portable warmers and heaters are not truly portable due to requiring wall current or open flame.

In addition, other devices have been tried but have other limitations. Various devices, such as sleeves serve to insulate a hot beverage from a person's hand, but do not effectively maintain the temperature or retard the cooling of the beverage. Other devices, such as foam insulators, can be bulky or difficult to hold, or can cause the vessel to become unbalanced when held, so as to result in spills. Such spills from hot beverages can be dangerous.

Vacuum bottles and highly insulated containers are also available for the purpose of maintaining the warmth of a beverage as well. However, drawbacks exist with respect to vacuum bottles and highly insulated containers. First, the bottle serves as the vessel itself and not as an insulator for a container. These bottles do now serve to "wrap" another vessel. As such, they usually require a lid that must be placed back onto the container after each use. Further, the beverage must typically be poured into another container for use, thereby eliminating the utility for more solid foods. Typically, plastic cups are included for pouring the hot beverage into. To some tastes, the plastic cups typically alter the taste of the beverage. Some thermal vacuum bottles have a rubber gasket within the lid that decays, comes apart and may fall into the beverage. The rubber gasket may acquire a bacteria residue which can be odorous and difficult to clean. Typically, if the rubber gasket fails, the entire device needs to be replaced. Some of the insulated containers that contain heating properties have ingredients that are chemical based and render vaporization problems. Further, because the same vessel is always used, and the contents are changed from one use to the next, such as from soup to coffee, an unacceptable after taste may remain behind. Further, these bottles may be difficult to clean.

SUMMARY OF THE INVENTION

The present invention overcomes the aforementioned limitations and is directed to a portable microwaveable container into which a mug, bowl, or other vessel may be inserted, wherein the container and its contents are microwaveable and wherein the interior of the container is comprised of heat-retentive matter, preferably containing a microwaveable food grade material which, when exposed to microwave energy or heated in some other more conventional way, heats to an acceptable temperature without damage to the container or heat-retentive matter, and in which the container is reusable.

It is an object of the present invention to provide an insulating container which houses a mug or other vessel, where said mug or other vessel contains a food product at an elevated temperature.

It is also an object of the invention to provide an insulating container which is safe to the touch and need not be connected to or use an electrical source while providing insulating benefit.

It is also an object of the invention to provide an insulating container in which another vessel may be housed, including where said vessel includes a protruding handle.

It is also an object of the invention to provide an insulating container that is reusable and microwave safe.

It is also an object of the invention to provide an insulating container that. stabilzes a mug or other vessel with a hot beverage within it to prevent potential spills.

The heated container of the present invention includes an opening, or receptacle area, into which a mug, a bowl or other vessel may be inserted. If a hot beverage or food is in the vessel, because of the heat transfer properties of the container of the present invention, the container serves to slow the rate of heat loss of the hot beverage or food in the vessel.

Although the container is intended for an average mug that is not greater than 3.5 inches in diameter to be utilized, the container may be of other sizes and dimensions as well, so as to be useful for vessels other than traditional mugs.

The container may be utilized in a corporate or domestic environment or where ever a typical microwave is available.

The container of the present invention affords several benefits. First, the internal portion of the container preferably is comprised of edible subject matter so as to assure it is biodegradable at the end of its useful life. It is reusable—that is, it can be heated numerous times without issue.

Although the container of the present invention can be heated in a microwave oven, and does warm, it is not overly sensitive to the touch. The exterior of the container is comprised of materials, such as paper mache or other paper products, which, even after heating, are not overly sensitive to the touch.

Further, depending upon the design and materials used, the container can have a uniform weight distribution or, preferably, can be weighted at the bottom and/or sides by including more dense matter in some areas. Such a design improves stability of the device, thereby improving safety. Also, the design of the present invention includes a slot, which may be tapered, so as to allow a handled mug to be inserted.

Finally, the container of the present invention may include additional options. The container can include an optional cover that is placed, snapped-on, or hinged for further insulation benefit, and the cover may include a combination of air vents and shaping so as to reduce condensation build up on its interior. A handle may be optionally included as well. In addition or in place of a cover, a handle may be provided to ease carrying. Also, a friction pad for improving stability can be included on the bottom. Also, the exterior of the container is suitable for displaying a logo or other advertising, which may be applied in any number of ways such as, but not limited to, decals or painting.

DETAILED DESCRIPTION

Figure 1:
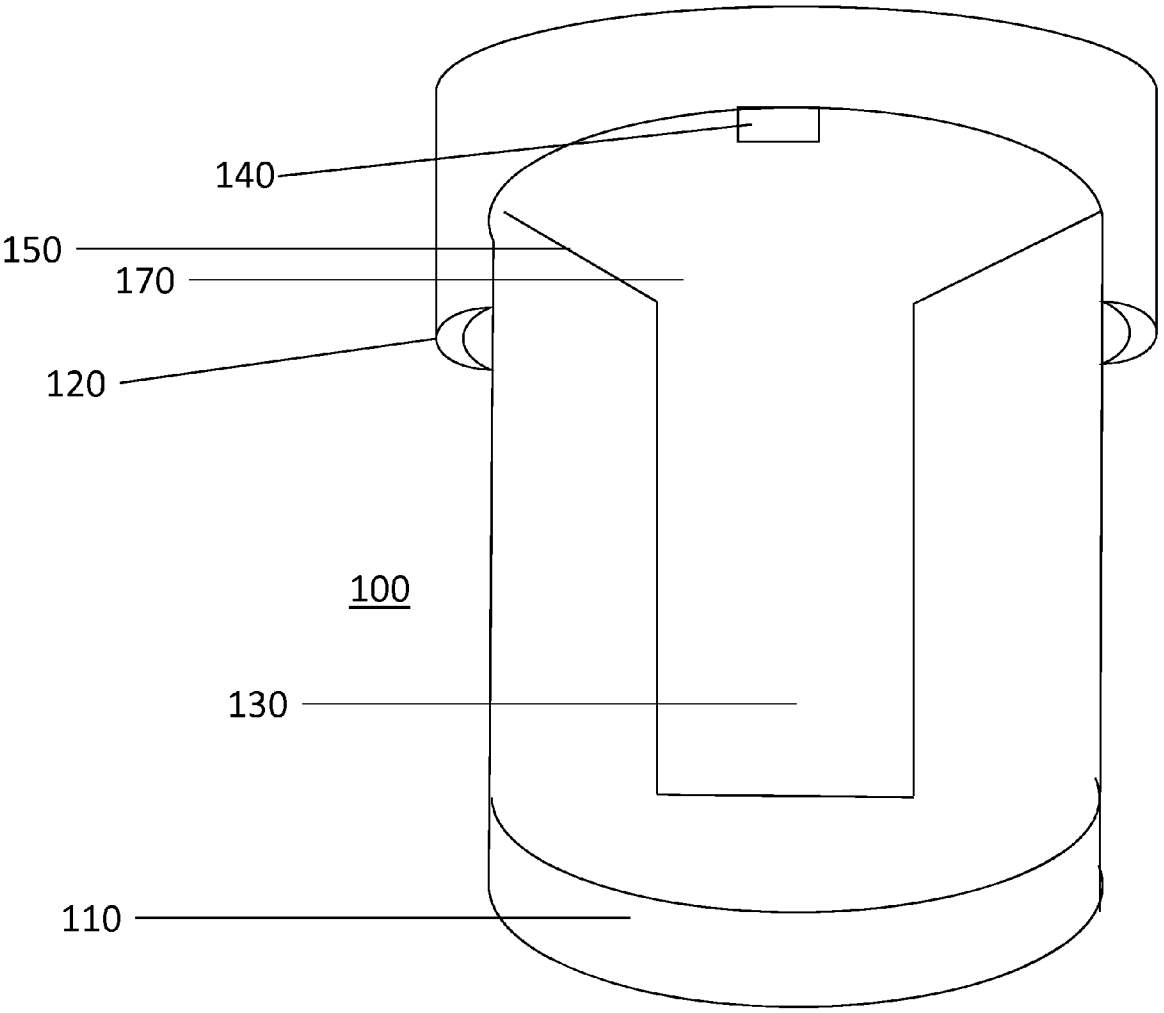
FIG. 1 is a front perspective of the container of the present invention shown with an optional handle raised above the container.

The present invention is directed to a microwaveable heat retentive container with a cavity for inserting a mug, bowl, or other vessel, where the vessel contains a hot food product such as coffee or tea. The exterior of the container of the present invention is preferably comprised of a pulp product and the interior is comprised of one or more heat retentive materials so that the container is preferably biodegradable, such as in a landfill.

In general, the container of the present invention includes an exposed exterior portion and an interior chamber, and is shaped largely cylindrically with a side portion and a base portion. The exterior of the container of the present invention is comprised of one or more materials and a filled interior comprised of possibly different materials. The exterior is formed of a pulp product, and preferably formed of a paper mache or alternatively a cardboard product, such as corrugated cardboard. The external material includes characteristics of durability, structural integrity, and should not mis-form when wetted. The preferred biodegradable pulp product is extremely durable and can be used multiple times. In the alternative, the exterior may be formed of a plastic.

The interior chamber of the container is comprised of one or more heat retentive elements. Preferably, the interior chamber is filled or nearly filled. The side interior chamber may be separate from the base interior chamber. The interior chamber preferably includes a biodegradable food grade blend that includes, but is not limited to feed, grain and seeds. The feed, grain and/or seeds are a food grade substance that is easily biodegradable and reheatable numerous times. In the preferred embodiment, the interior material is wheat berries alone, but other materials can be used in addition or in place of wheat berries.

The heat retention of the hot material in the vessel is prolonged by the heat retentive container after the container is heated, preferably by microwave and the vessel is inserted into the container. The heat retentive container is preferably microwaved 1.5 minutes on high with a preferred range of 1-2 minutes. Resulting temperatures of the interior of the container vary depending upon the microwave oven and the contents and density of the interior of the container, therefore, some experimentation may be needed while microwaving the container.

Once the container is warmed, a vessel, such as a mug, with hot contents within it is placed in the container and the container can be carried with the hot beverage in the vessel together to a destination such as a desk, table, counter top or coffee table and the like.

The invention is versatile in possible size. In the preferred embodiment, the container can have a mug inserted within it that has a diameter of 3.5 inches and contains a hot substance of 8 to 12 ounces. The contents in the mug should retain heat for approximately 1.25 to 1.5 hours after the invention has been microwaved approximately 1.5 minutes on high with a preferred range of 1-2 minutes. The contents of the mug initially should be at its hottest to assist in prolonging the heat of the contents.

Since there is still heat retained within the container, a second heating of the container would result in a higher temperature of approximately 215° F. and the heat would reduce slightly slower to result in an approximate temperature of 140° F. after 1.5 hours.

The container of the present invention is ripe with additional features, including maintenance and appearance. The container can easily be wiped cleaned. The top of the container may be recessed for decorative purposes.

The container's internal material is a heat-retentive, microwaveable material and is contained, and potentially sealed within the external portion of the container. Nominally, the available space on the side is 0.13 inches in width, nominally varying by 0.05 inches and extending through the entire height. The available space in the base is nominally 0.63 inches, nominally varying by 0.2 inches. In addition, the material must be usable for multiple uses—that is, the heat retentive ability should not decay significantly from use to use. The material is preferably comprised of a food grade material and potentially a blend of materials that heats easily upon microwave energy absorption to approximately 180° F. (1.5 minutes) and does not overheat the exterior of the container. The microwave ovens used in testing have a wattage range from 1100 W to 1350 W. The preferable microwaveable time of heating the container in this type of microwave oven is 1.5 minutes on high with a preferred range of 1-2 minutes, which can result in an interior temperature range from 180 to 190° F. After 1.5 hours of use and the first time heating the container, the internal material will retain some heat, therefore, the second heating will result in a higher initial temperature of approximately 210 to 220° F. for a preferred 1.5 minute heating duration of time.

In the alternative, the vessel with food may be placed in the container and they may be microwaved together.

The container of the present invention is generally cylindrical in shape, circular in cross section, and is preferably approximately 4.5 inches (nominally 4-5 inches) in diameter and approximately 4.5 inches (nominally 4-5 inches) tall, but the dimensions can differ so as to hold different sized vessels with a cavity along the side for a handle of a vessel. In the preferred embodiment, the external cavity is 3.5 inches (nominally 3-4 inches) in diameter and located as a vertical riser. The external cavity needs to be near the side of the circle so that the handle of the mug can protrude from the container. An overhead view of the container would depict a figure somewhat like the letter "C". The opening of the "C" would provide an opening for the handle of the mug to protrude. The protruding handle of the mug offers easy access to retrieve the mug for personal consumption of the contents of the mug. To properly use the container of the present invention in the preferred use, a user would place the container into the microwave 1.5 minutes on high with a preferred range of 1-2 minutes; put coffee into a mug and prepare as usual.

After the container has been microwaved, a user would place the mug with its contents into the cavity of the invention.

FIG. 1 depicts a frontal view of container 100 of the present invention including an optional handle. Container 100 has an open ended cavity 130 where a mug 160 (not included in this invention and not shown in FIG. 1) is placed. The shape of the cavity is generally cylindrical and circular at the bottom, and is sized as necessary to insure that a mug may fit in the cavity snugly and is surrounded by the heated material in the interior chamber's open ended cavity 130. Optional handle 105, which may also be microwavable and biodegradable, may be attached to the container of the present invention on each side via hinges 120 or other known techniques, so that the handle can rotate upwards to carry the container of the present invention and the mug together. An optional lid (not shown) is also hinged with hinge 140 so that the lid can stand upward while the consumer removes the mug to consume the contents of the mug. The lid needs to be raised before the mug is removed. Gap 170 allow for a mug handle to be outside container 100. Base 110, also formed of pulp paper product as the rest of container 100 is, is attached to the remainder of container 100 using off the shelf non-toxic glue.

As can be seen in FIG. 1, container 100 is generally circular in cross section, but the thickness varies such that the thickest portion is opposite gap 170 as it thins closer to gap 170. Further, gap 170 is provided so as to form an opening for a handle for a mug or other vessel which may be inserted inside the container. The purpose to this thinning is to ease access of the vessel handle. The top portion of the container may optionally be recessed inwardly. Recess 150 is optional and is included so as to aid in allowing spillage to remain inside the container.

The exterior of base 110 is constructed of the same microwavable biodegradable pulp product to cover the bottom of the container of the present invention. Alternatively, the exterior of base 110 and/or the remainder of the container can be formed of known paper-based or plastic-based materials, such as those which may be less sensitive to touch when hot. Optionally, the bottom of the base may be further covered with a high friction material so as to improve stability.

An additional purpose of this exterior is to insure the protection of the internal food grade substance from coming into contact with water when the container of the present invention is being cleaned.

The base can also be weighted more heavily than the sides, such as by using alternate internal materials, so as to, for example, improve stability.

Figure 2:
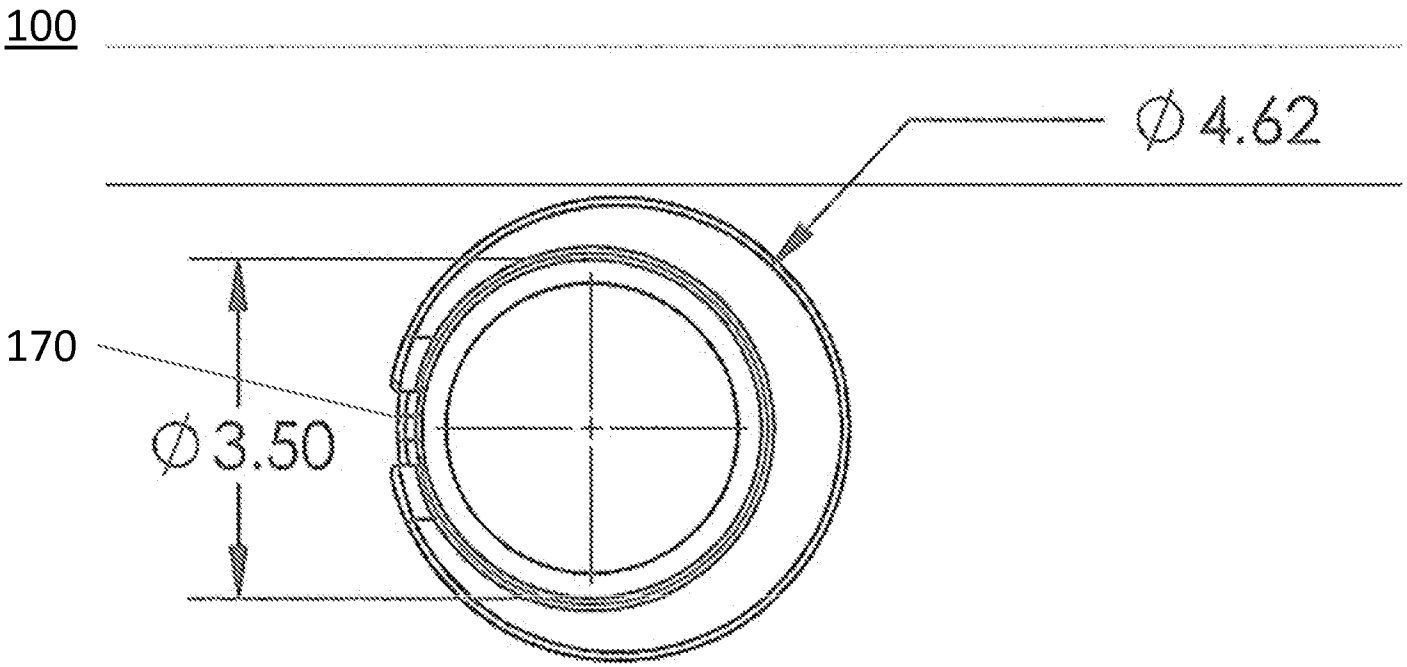
FIG. 2 is a top down view of the container of the present invention.

FIG. 2 depicts a top down view of the container of the present invention, absent the optional cover, associated connecting materials, and handle.

Particularly shown is container top 180 (See FIG. 4), and FIG. 2 shows the changing thickness relative to gap 170. In the preferred embodiment, both the inner and outer edges of container 100 are circular in cross section.

Figure 3:
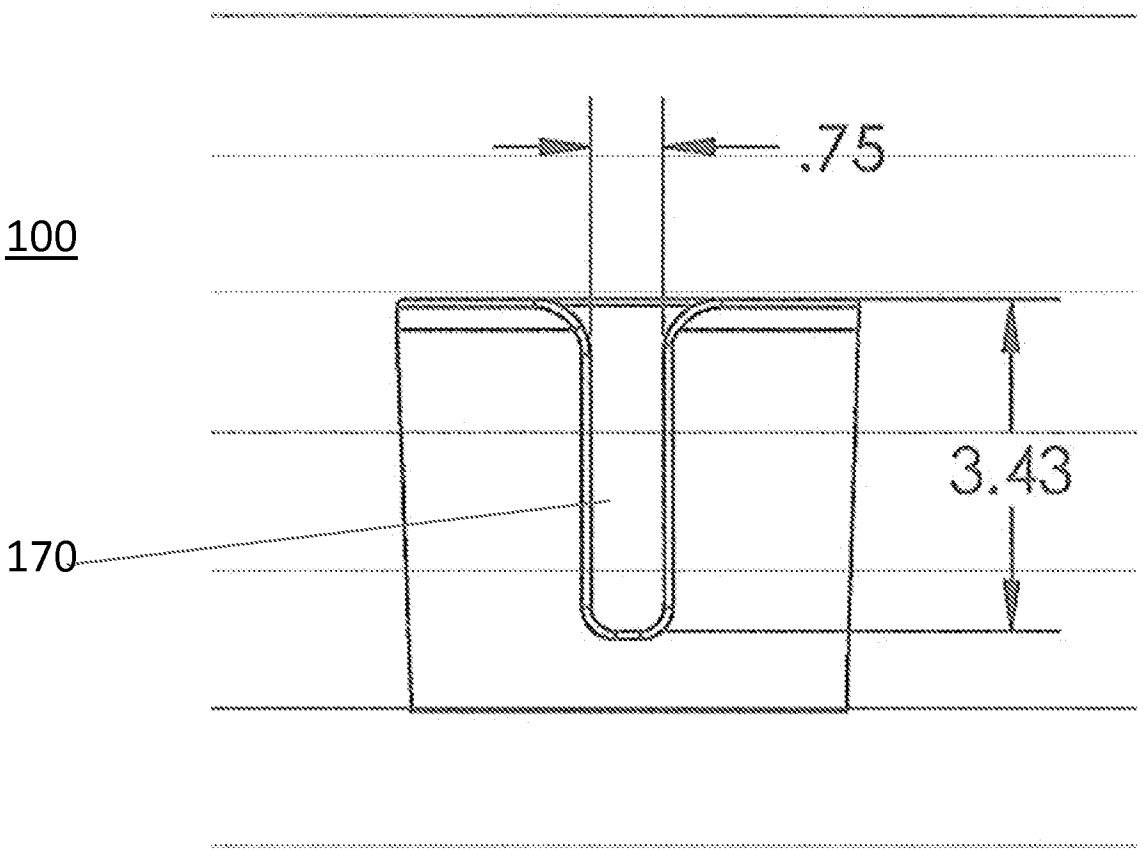
FIG. 3 shows a side view of the container of the present invention absent its base, particularly showing the slot for a mug handle.

FIG. 3 depicts a side view of the container of the present invention, particularly indicating the opening for a mug handle. Gap 170 is shown extending from the top most of the way to the bottom, so as to allow a mug handle to extend outside of container 100. Nominal dimensions are shown; however, these dimensions are exemplary and should not be perceived as the only option.

Figure 4:
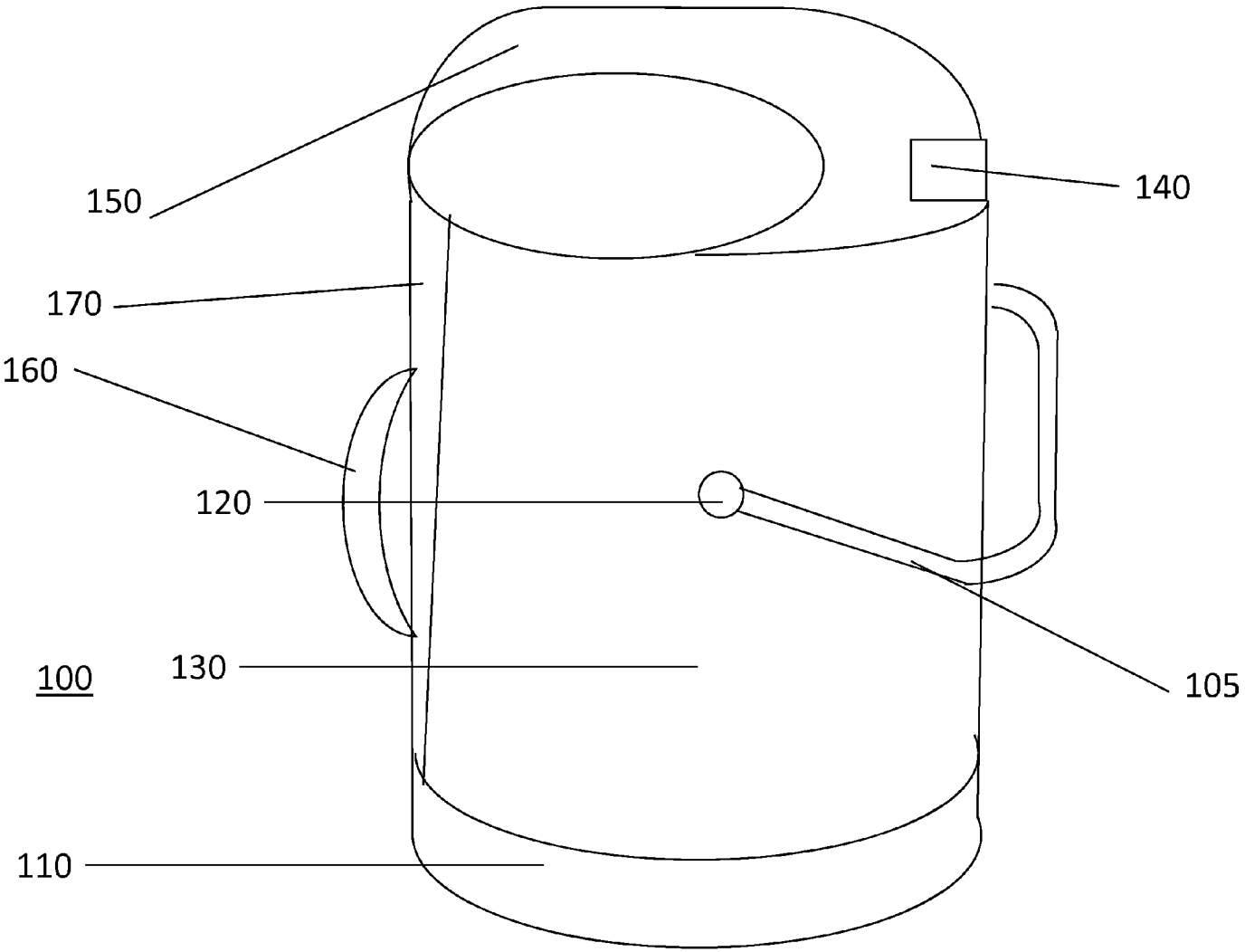
FIG. 4 is a side perspective of the container of the present invention shown with the optional handle lowered and a mug inside the container of the present invention with the handle of the mug protruding from the container of the present invention.

FIG. 4 shows a side view of the container with optional handle 105 down and resting against the container. The container has an opening to the side for mug 260 (with mug handle 160) (the mug is not a part of the present invention) to extend outward for easy access. A cutaway portion 165 illustrates heat retention material within the internal side chamber.

Figure 5:
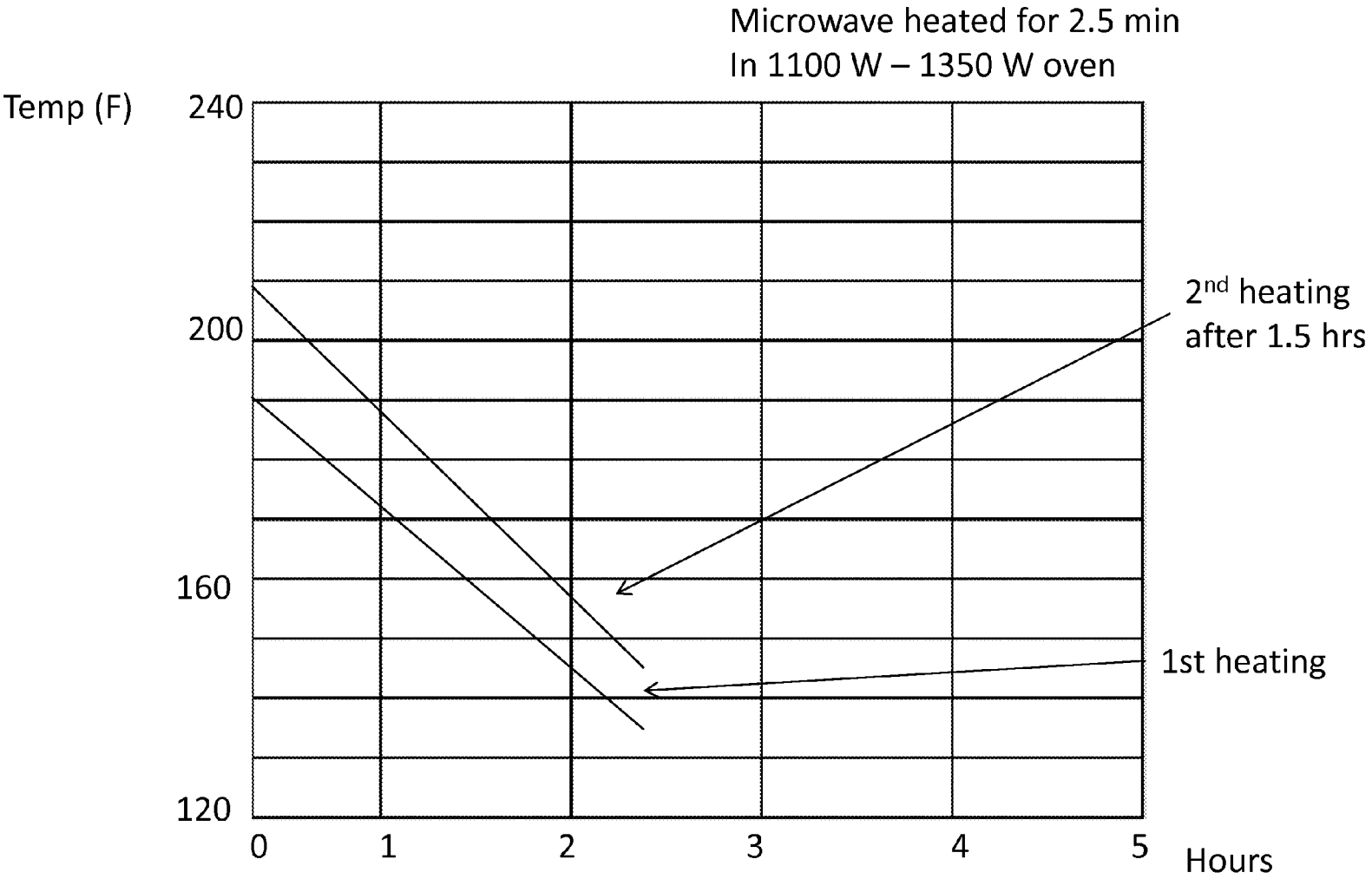
FIG. 5 is a graph of the thermal efficiency of the container of the present invention that has a mug containing a hot beverage consisting of 8 to 16 ounces.

FIG. 5 depicts a graphical representation of the tests that have been completed with regard to heat retention. The initial heating of the container results in an initial internal temperature of approximately 185° F. when heated in a microwave oven rated at 1100 W to 1350 W. After each half hour in an ambient environment (approximately 70° F.), the internal temperature would reduce by approximately 15 to 20° F., resulting in a temperature of approximately 140° F. after 1.5 hours.

Figure 6:
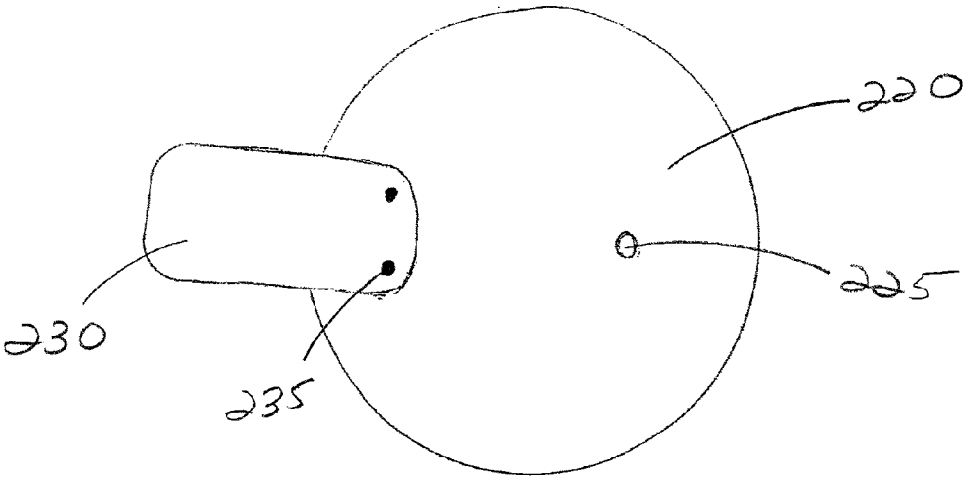
FIG. 6 is the top view of the detachable lid with the top of the attachable mechanism.
Figure 7:
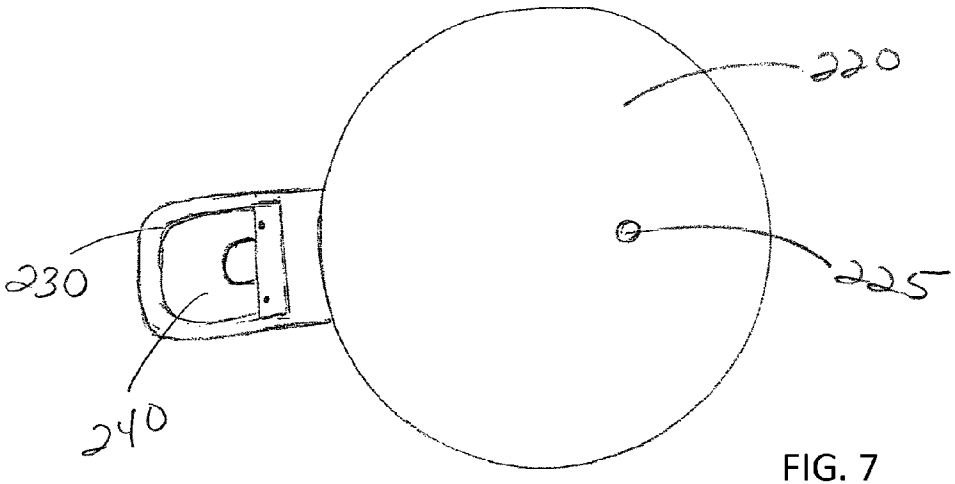
FIG. 7 is a bottom view of the detachable lid showing the bottom the attachable mechanism.

With reference to FIGS. 6 and 7, an optional detachable lid 220 is also available. The detachable lid 220 designed to further prolong the temperature of the contents of the mug 260 and retain a net loss of heat in the container. The lid assembly includes several elements.

The lid attaches to depressed area 140 on the top rear of the container. There is a small hole opening 225 on the top of the lid for the steam to escape and so as to reduce condensation. Extension 230 is the top of the mechanism that attaches to depressed area 140 of the lid. Screws 235 attach the detachable lid to the top of the lid. Clip 240 attaches to the depressed area 140 of the container and hinge 250 connects to lid 220, including the clip 240 and lid extension 230 and allows the lid to flip up by pressing on the top of lid extension 230. Although clip 240 stays connected to the container, with a finger slightly pressing on the end of 230 the lip flips up. The entire lid and mechanism is preferably constructed of biodegradable plastic, but may be formed of alternate materials such as non-biodegradable plastic or ceramics.

The user may use their own mug. The mug can be tapered or straight up and down as long as the mug has a diameter at its widest section consisting of no more than 3.5 inches which is a typical size for most mugs.

A mug that is tapered or straight up and down may be utilized in the preferred embodiment of the container of the present invention as long as the diameter is not greater than 3.5 inches. The mug does not need to be snug in the cavity to receive the benefits noted in this invention. Alternatively, the container of the present invention is sized differently to accommodate alternate vessels.

The invented container also offers greater support for the mug in the event the mug is accidentally knocked and the contents are spilled the container has a solid base which makes knocking this mug over more difficult than if the mug was standing alone.

Among the properties of this invention are the following:

Green: The entire product is created with biodegradable components. Therefore, after discarding this product, the product is estimated to exist in landfills similar to other pulp products.

The heat retentive material is a biodegradable food substance.

The user will be able to use their own mug. The mug can be tapered or straight up and down.

The invention does not need an electrical outlet at that site which would save electricity. Also, electrical outlets may not be readily available at the site of the desk or countertop.

Due to the fact that electricity at the site is not needed, the potential fire hazard is eliminated, i.e., hot plates which need to receive a constant flow of electricity to stay hot.

The contents of the mug such as coffee or tea will not burn at the bottom of the mug, therefore, the taste of the contents will retain its integrity.

Cost savings. Allowing someone to consume the contents of the mug for a longer period of time prevents the disposal of cold, unwanted liquids, therefore, preventing additional costs of those items such as coffee or tea.

Time saver. Time is valuable and having the hot contents retain the heat longer prevents the user from spending time obtaining more hot contents, having their secretary obtain another mug of hot contents or taking time from a house care professional from wasting time or the contents of the mug while housework is being completed.

The container is portable and has a handle for someone to easily carry the container. The portable container does not require assembly and is self-contained. The present invention can be utilized but not limited to any area where a typical microwave appliance is available such as: home, corporate kitchens or RVs.

The invention claimed is:

1. A heat retaining device comprising: a biodegradable enclosure member having a cylindrical shape with an external cavity along the side thereof so that a handle of a mug can protrude therefrom, thus an overhead view of the container is a C-shape with the opening of the C being the external cavity and a thickness of the C near the opening of the C being less than a thickness of the C distal from the opening of the C, including an exterior and an internal side chamber forming the C-shape of the enclosure; a base, including an internal base chamber, and a quantity of granular heat retention material within said internal side chamber and said internal base chamber, said heat retention material being capable of being heated by thermal energy radiation and of retaining heat in a latent state.

2. The device of claim 1, wherein said exterior is transparent to microwave radiation.

3. The device of claim 1, wherein said exterior is a paper product and the quantity granular heat retentive material is natural grains and/or seeds.

4. The device of claim 1, wherein the density of the material in said internal base chamber is greater than the density of the material in said internal side chamber.

5. The device of claim 1, wherein said heat retentive material comprises at least one food grade substance.

6. The device of claim 5, wherein said food grade substance comprises wheat berries.

7. A microwaveable heat retentive container comprising at least one receiving portion for receiving a vessel, an external shell transparent to microwave radiation having a C-shaped top profile, a handle rotatably coupled to the external shell, an internal heat storage mass comprising a first microwave absorbing material; and a base portion comprising a second microwave absorbing material; wherein said first microwave absorbing material and said second microwave absorbing material comprises at least one biodegradable food product of natural grains and/or seeds.

8. The device of claim 7, wherein said exterior shell is transparent to microwave radiation.

9. The device of claim7, wherein said exterior shell is formed at least in part of a paper product.

10. The device of claim 7, wherein the density of said second microwave absorbing material is greater than the density of said first microwave absorbing material.

11. The device of claim 7, further comprising a lid selectably coupleable to a depressed area on a top rear of the container by a clip; wherein the lid includes a hole disposed through a top to permit steam to escape.

12. The device of claim 11, wherein said microwave absorbing material comprises wheat berries; and wherein the lid includes an extension extending outwardly therefrom that allows the lid to flip up by leverage of a user pressing on the top of the lid extension.

* * * * *